US005507353A

United States Patent [19]

Pavone

[11] Patent Number: 5,507,353

[45] Date of Patent: Apr. 16, 1996

[54] METHOD AND SYSTEM FOR CONTROLLING THE ROTARY SPEED STABILITY OF A DRILL BIT

[75] Inventor: Didier Pavone, Eaubonne, France

[73] Assignee: Institut Francais du Petrole, Rueil Malmaison, France

[21] Appl. No.: 350,850

[22] Filed: Dec. 7, 1994

[30] Foreign Application Priority Data

Dec. 8, 1993 [FR] France ..... 93 14837

[51] Int. Cl.[6] ..... E21B 44/00; E21B 47/00

[52] U.S. Cl. ..... 175/27; 175/26; 175/40

[58] Field of Search ..... 175/27, 40, 24, 175/26

[56] References Cited

U.S. PATENT DOCUMENTS

| | | | |
|---|---|---|---|
| 1,703,234 | 2/1929 | Halliburton | 175/27 X |
| 1,786,173 | 12/1930 | Scharpenberg | 175/26 |
| 1,935,105 | 11/1933 | Woollen | 175/26 |
| 3,550,697 | 12/1970 | Hobhouse | 175/26 |
| 3,593,807 | 7/1971 | Klima | 175/27 X |
| 3,675,727 | 7/1972 | Clark | 175/27 X |
| 4,660,656 | 4/1987 | Warren et al. | 175/26 |
| 5,226,332 | 7/1993 | Wassell | 175/40 X |
| 5,277,061 | 1/1994 | Draoui | 175/40 X |

OTHER PUBLICATIONS

Dufeyte et al., "Detection and Monitoring of the Slip–Stick Motion: Field Experiments," 1991 SPE/IADC Drilling Conference, 11 Mar. 1991, Amsterdam, pp. 429–438.

*Primary Examiner*—Stephen J. Novosad

*Attorney, Agent, or Firm*—Millen, White, Zelano & Branigan

[57] ABSTRACT

A method and a system suited for controlling the behavior of a drill bit includes an additional resistant torque added to the torque about the drill bit so that the overall torque about the drill bit is an increasing function of the rotary speed of the bit. The system includes control means suited for creating an additional resistant torque about the bit.

7 Claims, 5 Drawing Sheets

METHOD AND SYSTEM FOR CONTROLLING THE ROTARY SPEED STABILITY OF A DRILL BIT

FIELD OF THE INVENTION

The present invention relates to a method and to a system suited for controlling a dysfunction of the behaviour of a drill bit brought into rotation by means of a drill string. This dysfunction is commonly referred to as a "stick-slip" motion.

More generally, the present invention may be applied to the oscillatory behaviour of the rotary speed of a drill bit around an average speed imposed from the surface.

Stick-slip behaviour is well-known to drill men and it is characterized by noticeable rotary speed changes of the drill bit while it is driven by means of a drill string brought into rotation from the surface at a substantially constant speed. The bit speed may range between a practically zero speed and a bit speed value much higher than the speed applied to the string at the surface. This may notably lead to a harmful effect on the life of drill bits, on the increase in the mechanical fatigue of the drillpipe string and on the connections break frequency.

BACKGROUND OF THE INVENTION

The article "Detection and monitoring of the stick-slip motion: field experiments" by M. P. Dufeyte and H. Henneuse (SPE/IADC 21,945—Drilling Conference, Amsterdam, 11–14 March 1991) analyzes the stick-slip behaviour from measurements carded out by a device placed at the upper end of the drill string. If a stick-slip type dysfunction appears, this document recommends either to increase the rotary speed of the drill string from the rotary table, or to decrease the weight on the bit by acting on the drawworks.

The article "A study of slip-stick motion of the bit" by Kyllingstad A. and Halsey G. W. (SPE 16,659, 62nd Annual Technical Conference and Exhibition, Dallas, Sep. 27–30, 1987) analyzes the behaviour of a drill bit by using a pendular model.

The article "The Genesis of Bit-Induced Torsional Drillstring Vibrations" by J. F. Brett (SPE/IADC 21,943—Drilling Conference, Amsterdam, 11–14 March 1991) also describes the torsional vibrations induced by a PDC type bit.

SUMMARY OF THE INVENTION

The present invention relates to a method for controlling the rotary speed stability of a drill bit driven into rotation by means of a drill string rotated from surface mechanical means, said bit being subjected to a reactive torque due to the drilling of a wellbore. According to the method, an additional resistant torque is induced in the neighbourhood of the bit, which depends on the bit rotary speed and on a determined value so that the overall reactive torque about the drill bit resulting from the addition of the torque about the bit and from said additional torque is an increasing function of the rotary speed of the bit.

Said additional resistant torque may be induced by friction means secured with the string in the neighbourhood of the bit.

Said additional resistant torque may be induced by a variation of the weight on the bit.

Said weight variation on the bit may be provided by specific means located in the neighbourhood of the bit and controlled by the rotary speed of the drill bit.

The invention further relates to a system for controlling the rotary speed stability of a drill bit driven into rotation by means of a drill string rotated from surface mechanical means, said bit being subjected to a reactive torque due to the drilling of a wellbore. The system includes control means secured with the string in the neighbourhood of the bit, said means being suited for creating an additional resistant torque about the bit, the value of said torque depending on the rotary speed of the bit.

Said control means may include friction means on the walls of the well.

Said control means may include means for varying the force of application of the bit onto the well bottom.

Said control means may include means for measuring the rotary speed of the drill bit and means for adjusting the value of the additional resistant torque as a function of the rotary speed of the bit.

BRIEF DESCRIPTION OF THE DRAWINGS

Other features and advantages of the invention will be clear from reading the description hereafter given by way of non limitative examples, with reference to the accompanying drawings in which.

DESCRIPTION OF THE PREFERRED EMBODIMENTS

Figure 1:
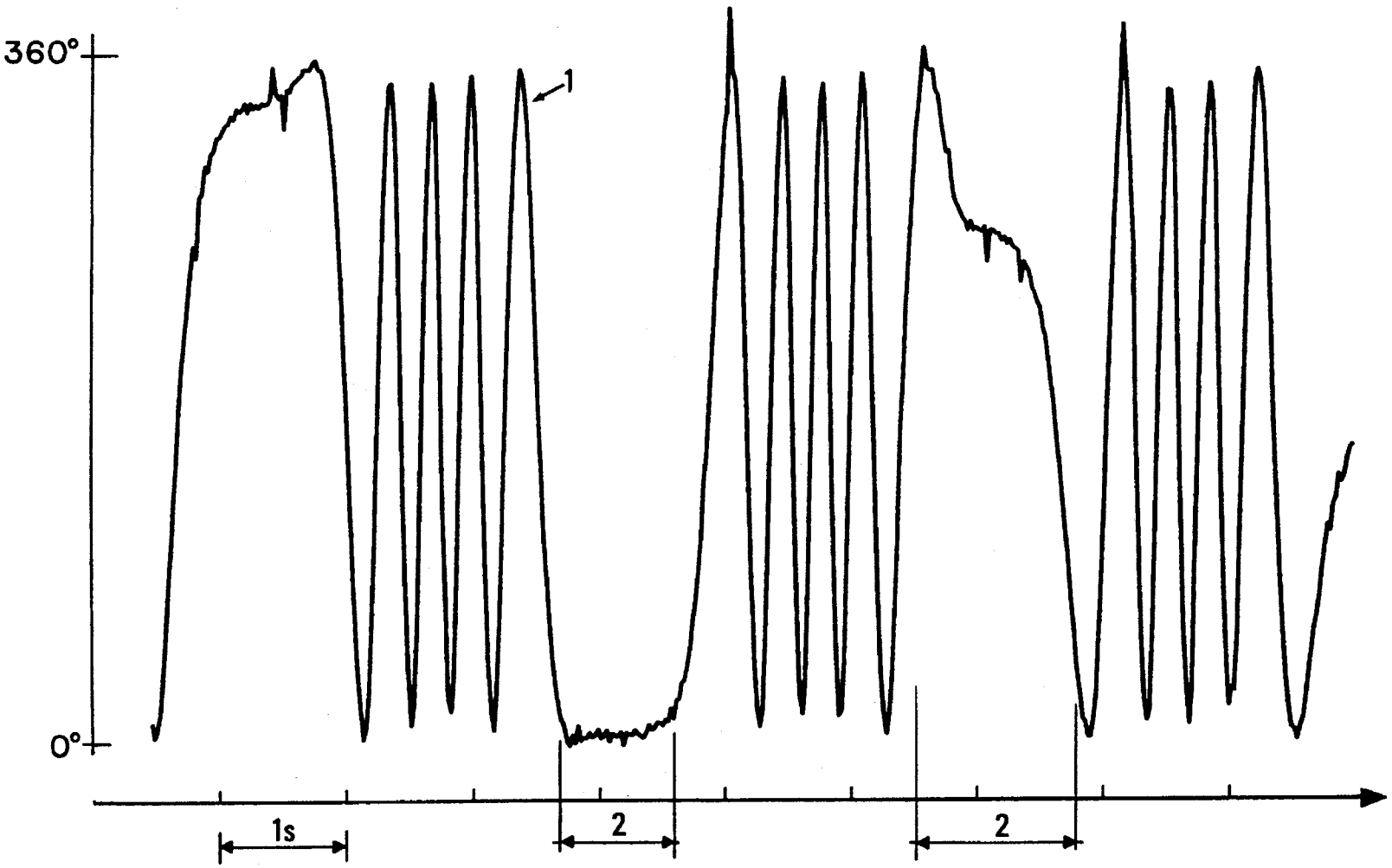
FIG. 1 shows a recording of the angular position of the bit as a function of time, FIG. 2 diagrammatically shows a model of a mechanical representation study of the behaviour of a drilling assembly.

FIG. 1 is a recording of the angular position of a drill bit immovably fastened to drill collars in which the measuring instruments are placed. These recordings have been obtained for example with the aid of the means described in patent FR-92/02,273. Such a recording curve is described in the article "Wired Pipes for a High-Data-Rate MWD System" by J. B. Faÿ, H. Faÿ and A. Couturier (SPE 24,971, European Petroleum Conference, Cannes, France, 16–18 November 1992). Measurements of the rotary speed of the bit may be preferably obtained by the derivation of curve 1 showing the recording of the angular position of the drill bit by arrays of magnetic sensors.

Measurement of the rotary speed of the bit may be likened to the rotary speed of the drill collars because the drill collar assembly is very stiff against torsional strain. There is thus practically no speed difference between the measuring means, preferably located in the drill collars for practical reasons, and the drill bit.

It may be seen that curve 1 of FIG. 1 shows zones 2 in which the displacement of the bit is practically zero during times substantially equal to one second. Furthermore, it may be seen, by counting the number of cycles per second, that the rotary speed may reach a 3.2-Hz frequency, whereas the design speed of the string, 90 rpm here, corresponds to a 1.5-Hz frequency.

This curve clearly illustrates the stick-slip dysfunction where the drill bit sticks on the formation (zero speed), then frees itself by undergoing strong accelerations which lead here to speeds higher than twice the speed of the drill string at the surface.

As a result of such a dysfunction, it may be noticed that most of the drill bits display abnormal wear and shorter lifetimes. Furthermore, the drillpipes connecting the drill collars to the surface are subjected to an alternate torsional strain and more particularly the pipe lengths located directly above the drill collars. Mechanical Fatigue is strongly marked there, which often imposes mechanical reinforcement of the pipes or leads to frequent breaks.

Figure 2:
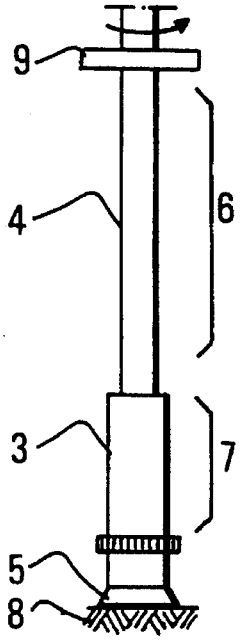

FIG. 2 diagrammatically shows the mathematical model used to demonstrate and to analyze the unstable behaviour of the rotary speed of the drill bit. A drill bit 5 lies on working face 8. The drill string is made up of drill collars 3 and of pipes 4 of predetermined mechanical and dimensional characteristics. A rotating device 9 imposes a rotary speed on the whole string. Frictions are imposed between the pipes and the drill collars against the walls of the well. The friction equations may be selected as a function of the weight of the whole string, of the rotary speed at table 9, of the drilling fluid, of the geometry of the pipes and of the drill collars respectively in zones 6 and 7, or of the form of the well trajectory. The rotation resistance of bit 5 on working face 8 is also defined according to a relation of the torque as a function of the rotary speed for a determined weight on the bit (FIG. 4).

Figure 4:
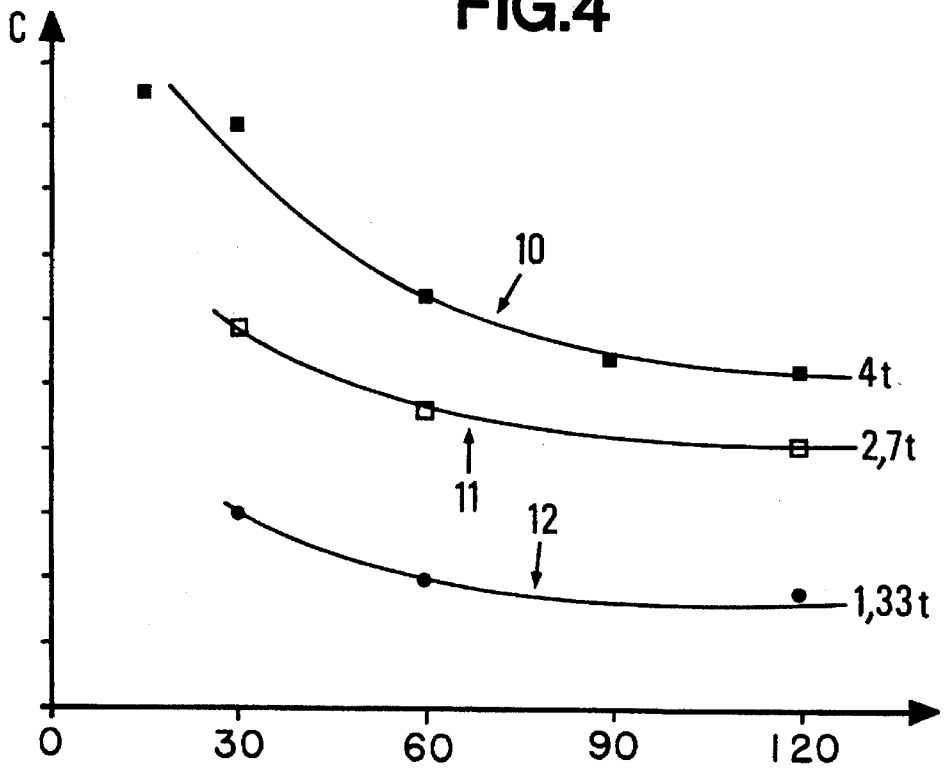
FIG. 4 shows an example of the value of the torque about a PDC bit as a function of the rotary speed for various weights on the bit.

FIG. 4 shows curb, is relating to the function between the friction torque (C) of a drill bit and the rotary speed thereof. This example has been published in article SPE 21,943 cited above. Measurements were carried out with a used PDC bit (one-piece bit including polycrystalline cutting tips), at a constant weight and for several values of weight on the bit. The abscissa is graduated in rpm and the ordinate in ft*lbf, a torque unit which may be converted into m*daN by multiplying by 0.1356. Curve 10 has been obtained for a 4-ton weight on the bit, curve 11 for a 2.7-ton weight on the bit and curve 12 for a 1.33-ton weight on the bit. It may be noticed that the torque about the bit decreases as the rotary speed increases. Moreover, when the weight on the bit decreases, the decreasing curve flattens.

This general shape of the curve representing the relation between the resistant torque about a bit and the rotary speed also applies to tricone type drill bits. In fact, this relation between the resistant torque and the sliding velocity is conventional, for example, it is well-known that the friction resulting from the movement of a vehicle tire also decreases with the rotary speed of the wheel (System Dynamics—A unified Approach, by Dean Kamopp and Ronald Rosenberg—John Wiley & Sons—Chapter 10—Tires, pp. 343–344). As for a tricone bit, the resistant torque about a moving vehicle wheel comes from the frictions due to the movement and to the sliding of the tire on the ground.

Figure 3:
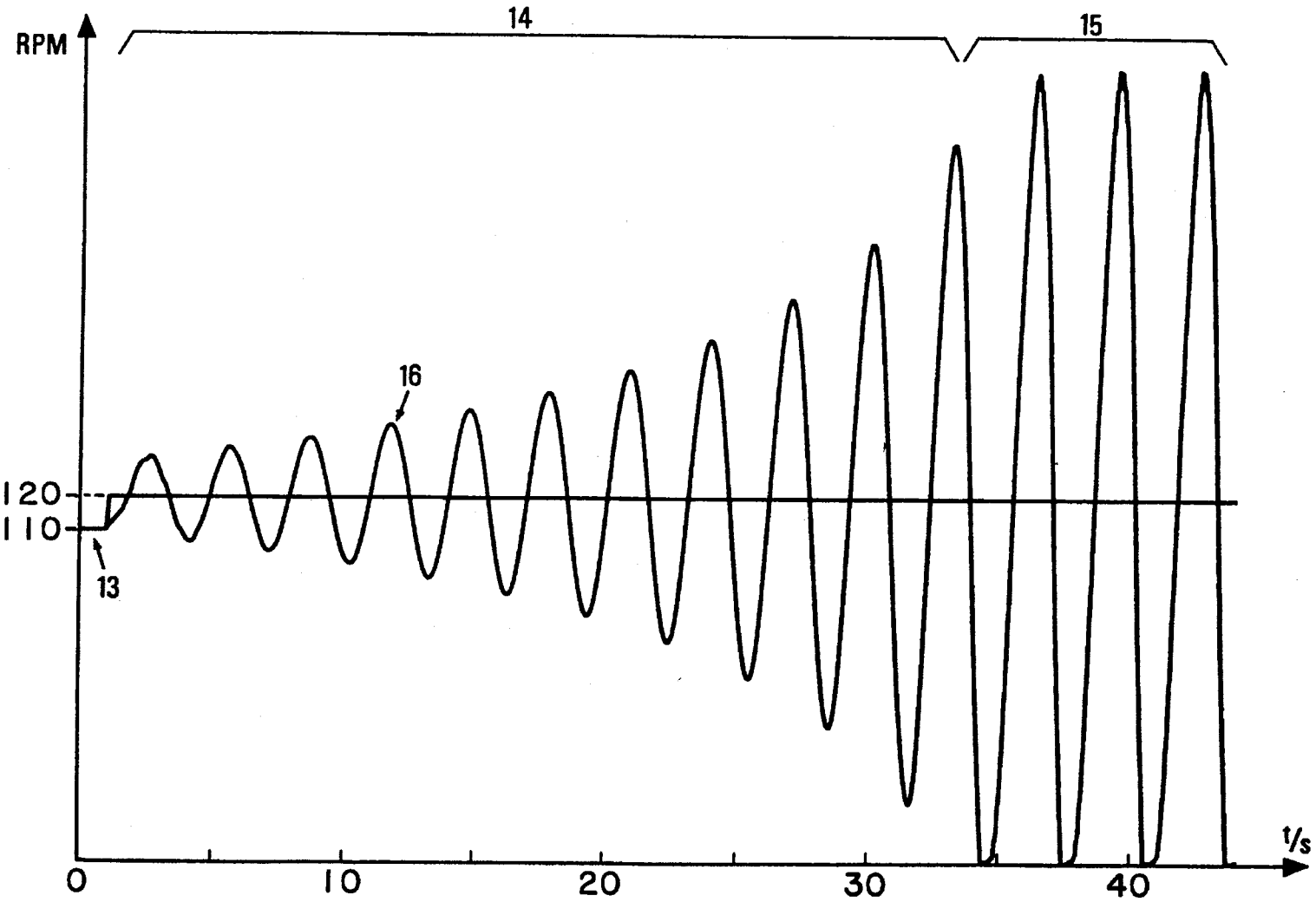
FIG. 3 shows the response of the model to an excitation corresponding to an increase in the rotary speed at the surface.

FIG. 3 shows the response of the mathematical model according to FIG. 2 to a stress created by a change in the rotary speed applied to the drill string by means 9 (FIG. 2). The friction conditions between bit 5 and working face 8 are imposed according to a law deriving from the curves of FIG. 4. At the time 0, the speed is 110 rpm. At the time referenced 13, the rotary speed applied to the drill string increases up to 120 rpm. Curve 16 represents the rotary speed of the drill bit as a function of time. The behaviour of the drill bit at rotary speed is unstable and oscillates around the 120 rpm set value. During the time referenced 14, the rotary speed of the bit varies according to oscillations which increase, then reach a maximum amplitude according to a stabilized behaviour (15) representing the stick-slip dysfunction in which the rotary speed becomes equal to zero before it reaches a maximum value much higher than the set speed value.

The model confirms and demonstrates that the instability of the rotary speed of a drill bit rotated by a drill string results from the fact that the torque about the bit decreases as a function of an increase in the rotary speed.

The present invention proposes that the appearance of the stick-slip dysfunction be prevented by making the behaviour of the drill bit stable at the rotary speed by acting upon the cause of the instability.

Figure 5:
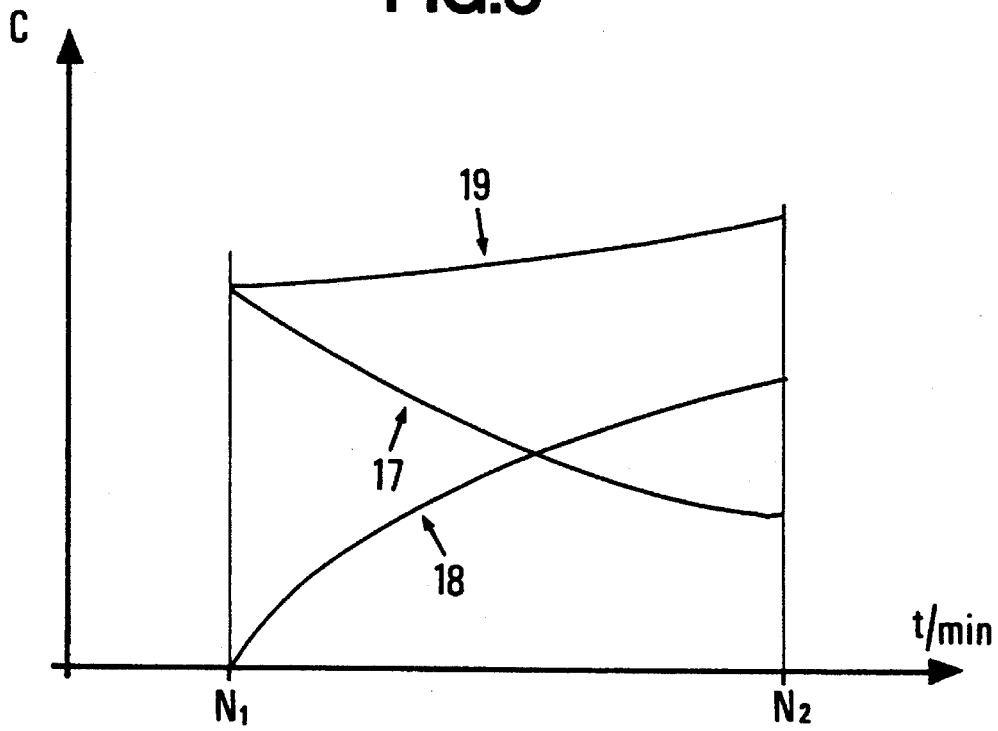
FIG. 5 graphically illustrates the addition of an additional torque about the drill bit, FIG. 6 graphically illustrates the consequence of the addition of a weight on the bit as a function of the rotary speed.
Figure 6:
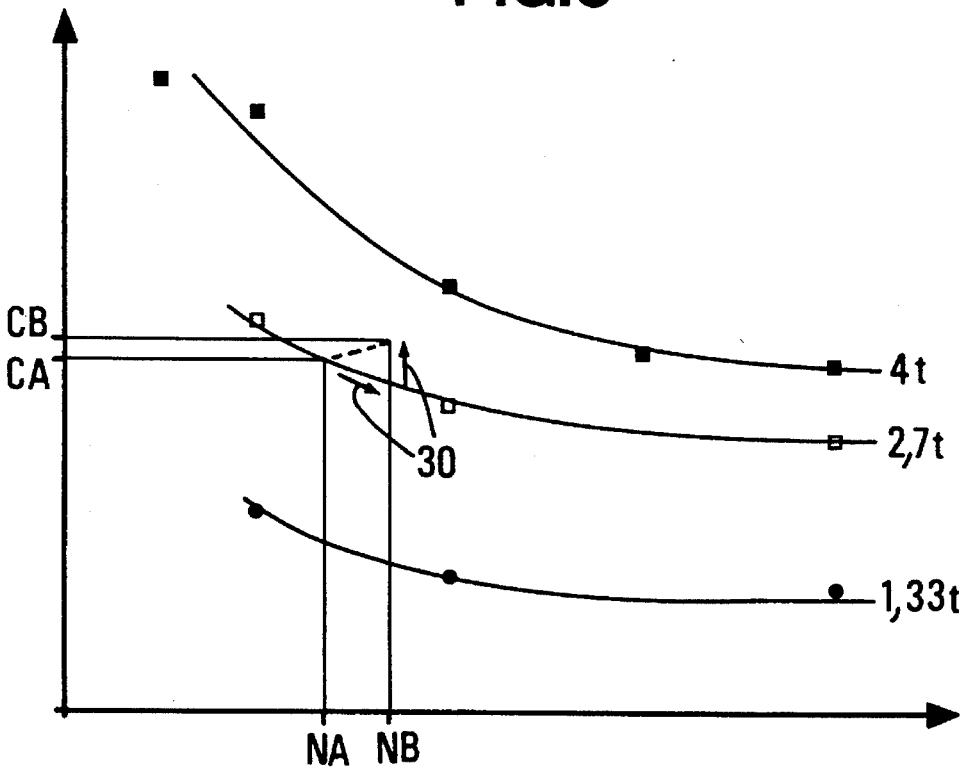

To that effect, two methods are preferably used and illustrated by FIGS. 5 and 6.

In FIG. 5, curve 17 represents the resistant torque about the drill bit within the range of rotary speeds N1 and N2. Curve 18 represents a friction torque provided by suited means secured with the drill bit or the drill collars. During operation between rotary speeds N1 and N2, the overall torque about the drill bit is the sum of the torque about the bit and of the additional torque. The overall torque is represented here by curve 19 resulting from the addition of curve 17 and curve 18. The friction means are determined to generate a friction curve 18 which increases with the rotary speed. The overall rotation resistance at the level of the drill bit is thus represented by a curve 19 which increases as a function of speed.

Under these conditions, when the rotary speed of the string varies within the range N1 and N2, the rotary speed of the drill bit oscillates around the average speed of the string but converges to the speed of the string. The stick-slip dysfunction will not appear. Simulation with the model of FIG. 2 confirms the stability of the drill bit speed.

The friction means may require measurement of the rotary speed of the drill bot so as to control, for example by means of electronic controls, the value of the additional torque as a function of speed. Purely mechanical means may thus be used as friction adjusting means.

Figure 7A:
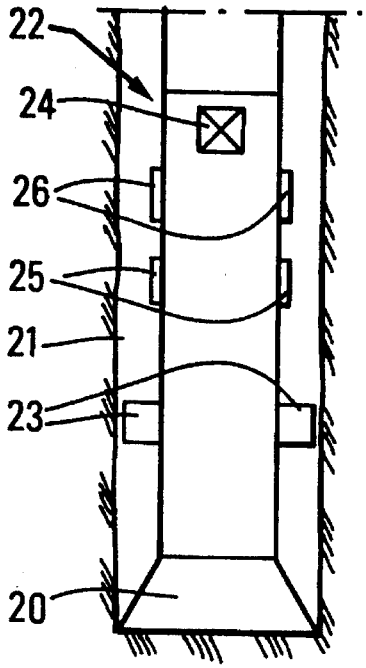
FIGS. 7A, 7B and 7C illustrate embodiments of the means for controlling the behaviour stability of the drill bit.

FIG. 7A illustrates friction means designed from a variable-geometry stabilizer 22. Means 22 are fastened to a bit 20 drilling a wellbore 21. Pads 23, 25, 26 display friction surfaces with the walls of wellbore 21 so as to create a friction torque. The amount of pads in contact with the walls depends on the speed measured by the measuring and monitoring device 24 controlling the coming out of the number of pads necessary for the additional resistant torque to follow a law of growth similar to curve 18. The variable-geometry stabilizers whose blades are radially mobile are well-known and will not be described here. A rotary speed pickup integrated in device 24 controls a motorization means which moves supporting blades radially against the wall of the well. The energy for activating the motor may come from an electric accumulator, from an electricity-generating turbine or from the pressure of the drilling fluid circulating in the string.

Figure 7B:
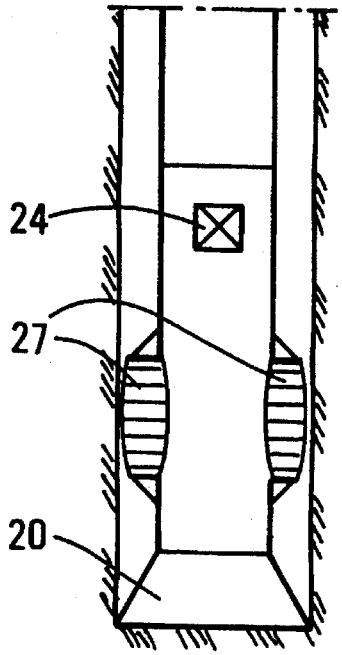

According to FIG. 7B, the friction pads may be replaced by rollers 27 whose axis is parallel to the axis of rotation of bit 20. The number of rollers distributed on the circumference is determined to provide a proper centering of the bit in the well. Push means, hydraulic or mechanical, lean the rollers against the walls of the well. The rotation of the drill bit rotates rollers 27 in contact with the walls of the well, for example like a rotary reamer commonly used in the profession would. Here, it not advisable for the surface of the rollers to be aggressive towards the walls, but sufficient for the rolling resistance to create an additional torque to the torque about the bit so that the stick-slip behaviour does not appear. A measuring and monitoring device 24 adjusts the rolling resistance according to the rotary speed for example by controlling the braking of the rollers and/or the force of application of the rollers on the walls of the well.

FIG. 6, which partly takes up FIG. 4, as an example only, illustrates another means for making the behaviour of a drill bit speed stable. Point A represents the working point at the 2.7-ton weight on the bit, at the rotary speed $N_A$ and at the torque $C_A$. When the speed increases from $N_A$ to $N_B$ while providing a weight increase on the bit corresponding, at point B, to substantially 3 tons, the working point follows the path shown by arrows 30. The torque about the bit becomes $C_B$ higher than $C_A$. An increase in the rotary speed has thus visibly led to an increase in the reactive torque about the bit. Under such conditions, the behaviour of the drill bit is speed stable as described above. To achieve this stability, the solution here consists in creating a determined weight increase on the bit as a function of an increase in the rotary speed.

Figure 7C:
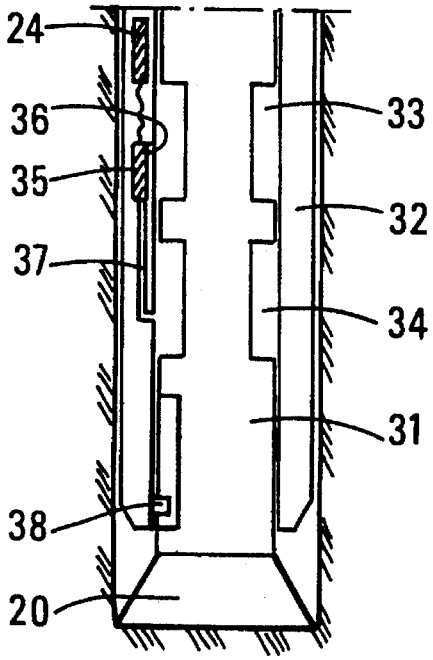

FIG. 7C shows the embodiment principle of means for applying an additional weight on the bit when the rotary speed increases. Bit 20 is screwed on a mandrel 31 contained in a body 32. Body 32 is secured with the drill collars. Mandrel 31 may slide longitudinally over a determined length while being fixed in rotation, for example by a key system 38 in a keyway. The shape of mandrel 31 is such that two annular chambers 33 and 34 are provided between the outside of the mandrel and the inside of body 32. Seal elements, not shown here, insulate the chambers with respect to each other and to the outside. These chambers are filled with a substantially incompressible fluid. Means 35 for adjusting the hydraulic pressure in chambers 33 and 34 communicate with these chambers through pipes 36 and 37. A measuring and monitoring device 24 controls adjusting means 25 according to the measurement of the rotary speed. Such means may work as follows: the drill man sets for example 2.7 tons on a bit driven into rotation by the drill string rotating at speed $N_A$. The drill man must see to it that there is a drill collar excess weight in the string so as to be able to apply a 0.3-ton weight increase for example. This safety on the drill collar weight is generally common in the profession. During drilling, when the bit speed changes from $N_A$ to $N_B$, device 24 detects this increase and gives adjusting means 35 the order to increase the hydraulic pressure in chamber 33 to such a value that this pressure increase corresponds to about 0.3 tons. According to the example of FIG. 6, the working point thus changes from the 2.7-ton curve 11 to a point B belonging to a 3-ton curve, not shown in the example. The behaviour of the drill bit is therefore that of a bit whose resistant torque increases with speed.

Without departing from the scope of this invention, other means may be used in order to obtain the same technical results as those described in the present specification.

I claim:

1. A method for controlling the rotary speed stability of a drill bit driven into rotation by means of a tubular string rotated from surface mechanical means, said bit being subjected to a reactive torque due to the drilling of a wellbore, comprising creating an additional resistant torque in the neighborhood of the bit, which torque depends on the rotary speed of the bit and on a determined value so that the overall reactive torque about the drill bit resulting from the addition of the torque about the bit and of said additional torque is an increasing function of the bit rotary speed.

2. A method as claimed in claim 1, wherein said additional resistant torque is created by friction means secured with the string in the neighborhood of the bit.

3. A method as claimed in claim 1, wherein said additional resistant torque is created by a weight increase on the bit.

4. A method as claimed in claim 3, wherein said weight increase on the bit is provided by specific means located in the neighborhood of the bit and activated by the rotary speed of the drill bit.

5. A system for controlling the rotary speed stability of a drill bit driven into rotation by means of a tubular string rotated from surface mechanical means, said bit being subjected to a reactive torque due to the drilling of a wellbore, characterized in that said system includes control means secured with the string in the neighborhood of the bit, said control means being suited for creating an additional resistant torque about the bit, the value of said torque depending on the bit rotary speed, said control means including means for measuring the rotary speed of the bit and means for adjusting the value of the additional resistant torque as a function of the rotary speed of the bit.

6. A system as claimed in claim 5, wherein said control means include friction means on the walls of the well.

7. A system as claimed in claim 5, wherein said control means include means for varying the force of application of the bit on the well bottom.

* * * * *